US008917036B1

(12) United States Patent
Sneider et al.

(10) Patent No.: US 8,917,036 B1
(45) Date of Patent: Dec. 23, 2014

(54) METHOD AND APPARATUS FOR DIMMING HIGH INTENSITY DISCHARGE LAMPS

(71) Applicant: General Electric Company, Schenectady, NY (US)

(72) Inventors: Janos Laszlo Sneider, Budapest (HU); Gergely Janos Ormandlaky, Budapest (HU)

(73) Assignee: General Electric Company, Schenectedy, NY (US)

( * ) Notice: Subject to any disclaimer, the term of this patent is extended or adjusted under 35 U.S.C. 154(b) by 0 days.

(21) Appl. No.: 13/970,893

(22) Filed: Aug. 20, 2013

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 41/38*** | (2006.01) |

(52) U.S. Cl.
CPC ..... *H05B 41/38* (2013.01); *Y10S 315/04* (2013.01)
USPC ..... 315/307; 315/274; 315/276; 315/291; 315/DIG. 4

(58) Field of Classification Search
None
See application file for complete search history.

(56) References Cited

U.S. PATENT DOCUMENTS

| | | | | |
|---|---|---|---|---|
| 5,483,126 | A | 1/1996 | Boenigk | |
| 5,751,116 | A | 5/1998 | Thomas et al. | |
| 6,271,635 | B1 * | 8/2001 | Daniel | 315/277 |
| 7,358,680 | B2 | 4/2008 | Deurloo | |
| 7,656,097 | B2 * | 2/2010 | Choi | 315/291 |
| 2009/0200954 | A1 * | 8/2009 | Li et al. | 315/246 |

FOREIGN PATENT DOCUMENTS

| | | | |
|---|---|---|---|
| DE | 102006060773 | A1 | 6/2008 |
| GB | 2388973 | A | 11/2003 |

OTHER PUBLICATIONS

International Search Report and the Written Opinion issued in connection with corresponding WO Application No. PCT/US2014/047987 dated Oct. 8, 2014.

* cited by examiner

*Primary Examiner* — Anh Tran
(74) *Attorney, Agent, or Firm* — GE Global Patent Operations; Peter T. DiMauro

(57) ABSTRACT

A method for operating a HID lamp using a bi-power electromagnetic ballast. The method includes applying a full power level to the lamp to produce full brightness and applying a dimmed power level to the lamp to produce a dimmed brightness. The lamp may be dimmed by switching the lamp power from the full power level to the dimmed power level and then applying a full power pulse to the lamp. The dimmed power level is less than the full power level.

20 Claims, 4 Drawing Sheets

METHOD AND APPARATUS FOR DIMMING HIGH INTENSITY DISCHARGE LAMPS

BACKGROUND

1. Field

The aspects of the present disclosure relate generally to high intensity discharge ("HID") light sources and in particular to bi-power electromagnetic ballasts for driving HID lamps.

2. Description of Related Art

A high intensity discharge or HID lamp is type of electric lighting device capable of producing a high level of light for its physical size by means of an electrical discharge. A controlled high intensity arc is maintained between two electrodes disposed within a glass or ceramic tube which is filled with gas and metal vapors. In general, HID lamps are favored for their long life, high light output, small size, and improved electrical efficiency as compared to fluorescent and incandescent lighting technologies. HID lamps are typically named by the type of gas and metal contained within the arc tube. Some of the more popular HID lamp types are high pressure sodium (HPS), quartz metal halide (QMH), and ceramic metal halide (CMH).

HID lamps, like fluorescent lamps, require a ballast circuit to provide the proper starting voltage for the lamp and limit operating current once the lamp is ignited. A ballast circuit or ballast is an electric circuit that limits the amount of current flowing through the lamp allowing long lamp life and efficient operation. HID lamps exhibit a negative impedance characteristic, which means that the lamp draws more current than is required for it to operate. Without a ballast circuit, running the lamp in this negative impedance condition would cause the lamp to self-destruct in a very short period of time. Typically, a HID ballast (sometimes with the addition of a capacitor and igniter) serves to start and operate the lamp in a controlled manner.

HID lamps can be driven from modern electronic ballasts which achieve power regulation, controllability, and are energy efficient. However, electronic ballasts are complex and costly, making them less desirable for some applications. Electromagnetic ballasts provide a low cost solution that is often more desirable than the high cost electronic ballasts. Electromagnetic ballasts use magnetic components to start and regulate the operation of a lamp and limit lamp current using inductors. Inductors cause a phase shift between the supply voltage and the current resulting in a reduced power factor. Often times, a capacitor is included in the ballast circuit to increase the power factor and improve overall efficiency of the lighting system.

There are additional factors that need to be considered when using HID lighting systems. HID lamps do not achieve their full light output immediately after starting. They require a warm-up period, which for certain types of metal halide lamps can be as long as 15 to 20 minutes. After a HID lamp has been on for a period of time and then extinguished, it cannot be immediately turned back on. The arc tube must have a chance to cool down or the lamp will not restart. This period of time is called the restrike time. Restrike times for HID lamps can be quite long. For example, a probe start type QMH lamp can have a restrike time of 10 to 20 minutes, while a HPS lamp may require 1 to 3 minutes before the lamp can be re-ignited.

In certain applications it is desirable to reduce the light output of HID lamps. For example, a HID lamp may be dimmed when the area they are lighting is unoccupied, or when full light level output is not desired. In these applications HID ballasts have been designed to support a dimmed mode of operation where the lamp power is dropped by as much as 50%. This can translate to significant energy cost savings in many HID lighting applications.

There are two general classes of HID dimming systems. In bi-level dimming, also known as bi-power dimming, HID lamps are run at two distinct power levels. A reduced power or dimmed power is used when less light is desired and full power is used when full lamp brightness is desired. Bi-level dimming systems are sometimes designed to occasionally raise the power level to full brightness during prolonged periods of dimmed operation to improve lamp life. The other common class of dimming system is called "continuous" dimming and allows users to select a desired wattage from a continuous range of wattage values thereby providing users with complete light control. Continuous dimming ballasts are more complex and costly than bi-level ballasts making them less desirable than bi-level systems in many lighting applications.

When HPS lamps and some CMH lamps, such as those used in street lighting, are used with bi-level dimming electromagnetic ballasts, they may drop out when switched to dimmed wattage operation. This failure depends on lamp voltage where higher voltage lamps are more susceptible to drop out due to a transient effect of temporary lamp voltage rise. Dimming of bi-level ballasts is typically achieved by lowering the lamp power in a single step after which the lamp voltage may rise for a short period of time. As lamp voltage rises to near the open circuit supply voltage, the lamp may drop out or extinguish thereby requiring a long cool down period before re-strike can occur.

Accordingly, it would be desirable to provide bi-power electromagnetic ballasts that address at least some of the problems identified above.

BRIEF DESCRIPTION OF THE DISCLOSED EMBODIMENTS

As described herein, the exemplary embodiments overcome one or more of the above or other disadvantages known in the art.

One aspect of the exemplary embodiments relates to a method for operating a HID lamp using a bi-power electromagnetic ballast. In one embodiment, the method includes applying a full power level to the lamp to produce full brightness and applying a dimmed power level to the lamp to produce a dimmed brightness. The lamp may be dimmed by switching the lamp power from the full power level to the dimmed power level and then applying a full power pulse to the lamp. The dimmed power level is less than the full power level.

Another aspect of the exemplary embodiments relates to a bi-power electromagnetic ballast for driving a HID lamp. In one embodiment the ballast includes a ballasting power circuit configured to receive an AC input power and produce a lamp power at a full power level or a dimmed power level. A dimming circuit is coupled to the ballasting power circuit and configured to operate the ballasting power circuit to produce the full power level or the dimmed power level. The dimmed power level is lower than the full power level. The dimming circuit is configured to dim the lamp by switching the lamp power from the full power level to the dimmed power level, wait a first period of time, switch the lamp power from the dimmed power level back to the full power level, wait for a pulse time, and then switch the lamp power from the full power level back to the dimmed power level.

Another aspect of the disclosed embodiments relates to an electric lighting apparatus. In one embodiment the electric lighting apparatus includes a bi-power electromagnetic ballast configured to receive an AC input power and produce a lamp power at a full power level or a dimmed power level. A HID lamp is coupled to the electromagnetic ballast and configured to receive the lamp power. The bi-power electromagnetic ballast is configured to produce the full power level and the dimmed power level, wherein the full power level is greater than the dimmed power. The electromagnetic ballast is further configured to dim the HID lamp by reducing the lamp power from the full power level to the dimmed power level, and then applying a full power pulse to the HID lamp.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

DETAILED DESCRIPTION OF THE DISCLOSED EMBODIMENTS

Figure 1:
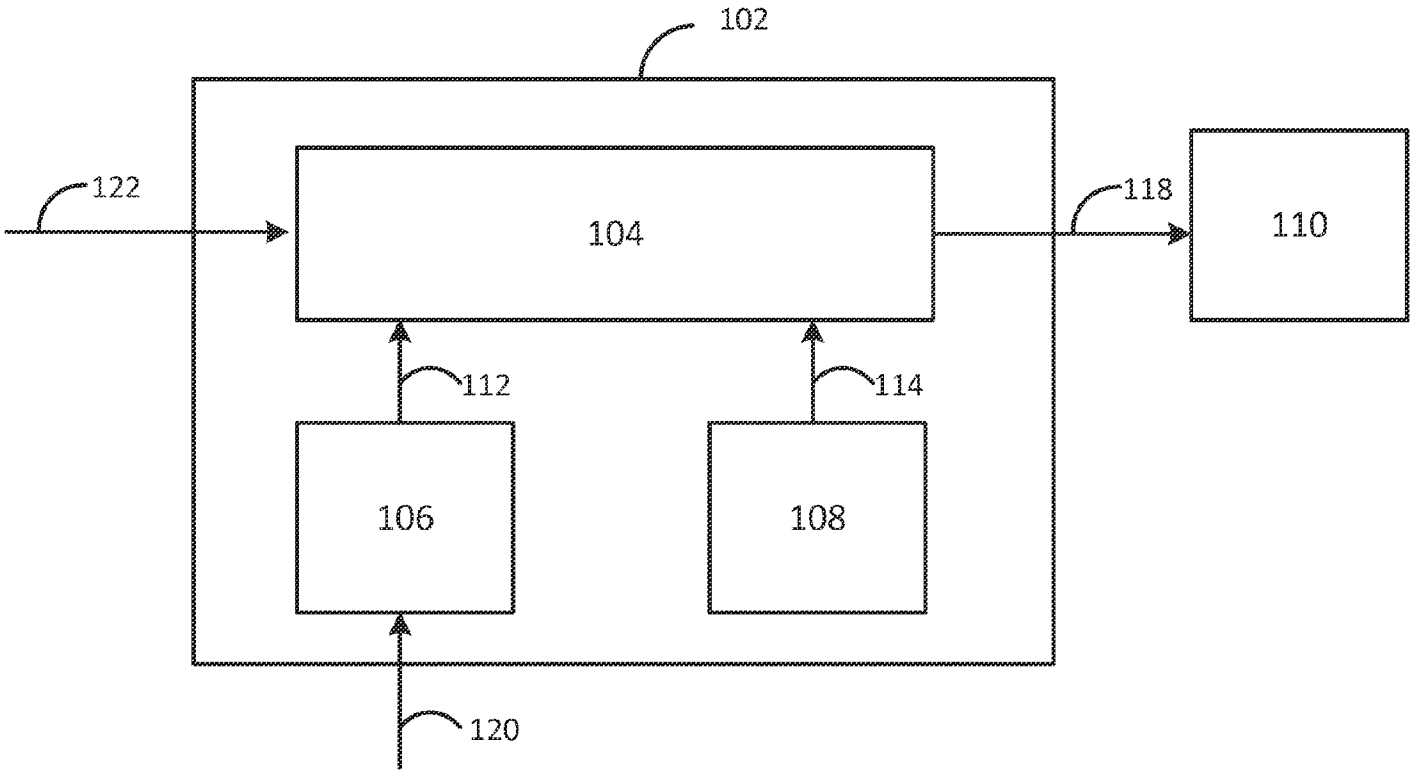
FIG. 1 illustrates a block diagram of a HID lighting apparatus incorporating aspects of the present disclosure.

Referring now to FIG. 1 there can be seen a block diagram of a HID lighting apparatus that includes a bi-power electromagnetic ballast 102 coupled to a HID lamp 110. The aspects of the disclosed embodiments are generally directed to avoiding extinguishing of an HID lamp after transitioning the lamp to a dimmed power lamp. A bi-power, or bi-level, electromagnetic ballast is a type of electromagnetic ballast circuit that can provide two levels of lamp power allowing a HID lamp to operate at either full brightness or dimmed brightness. The bi-power electromagnetic ballast 102 is configured to receive AC input power 122 and output or produce a lamp power 118 for powering the HID lamp 110. The input power 122 may be any suitable AC power such as the locally available mains power, for example the 120 volt (V) 60 Hertz (Hz) power generally available in North America or the 230V 50 Hz power available in many European countries or other suitable AC power sources. The lamp power 118 is an AC power signal with a frequency substantially similar to the frequency of AC input power 122 which can be maintained at either of two different wattage levels, a full wattage for operating the HID lamp 110 at full brightness and a reduced wattage or dimmed wattage for operating the HID lamp 110 at a dimmed brightness. The bi-power electromagnetic ballast 102 receives a dimming control signal 120 from an external source such as a timer circuit or manually operated switch.

In one embodiment, the bi-power electromagnetic ballast 102 includes a ballasting power circuit 104 to limit lamp current and control lamp power 118 at the desired power level. Current limiting functionality is typically accomplished using inductive components. Since inductive components cause a phase shift between the input current and input voltage, capacitors may be included in the ballasting power circuit 104 to improve the overall power factor of the bi-power electromagnetic ballast 102.

Many HID lamps require a starting voltage to initiate an arc within the lamp 110. To support starting of the lamp 110, in one embodiment, the ballast 102 may include a starting circuit 108 to provide a starting signal 114 at lamp startup time to provide a proper starting voltage to HID lamp 110. In certain embodiments it is desirable to reduce lamp power at times when full lamp brightness is not required. Reducing lamp power can result in significant energy cost savings as well as extending the life of some types of HID lamps.

To support reduced power operation a dimming circuit 106 is included and is configured to operate the ballasting power circuit 104 at the desired full power or reduce dimmed power mode. The dimming circuit 106 receives the dimming control signal 120 indicating whether to operate the HID lamp 110 at full or dimmed brightness. The dimming circuit 106 generates a dimming signal 112, which is coupled to the ballasting power circuit 104 and configured to operate the power circuit 104 at the desired full power or dimmed power level.

Figure 2:
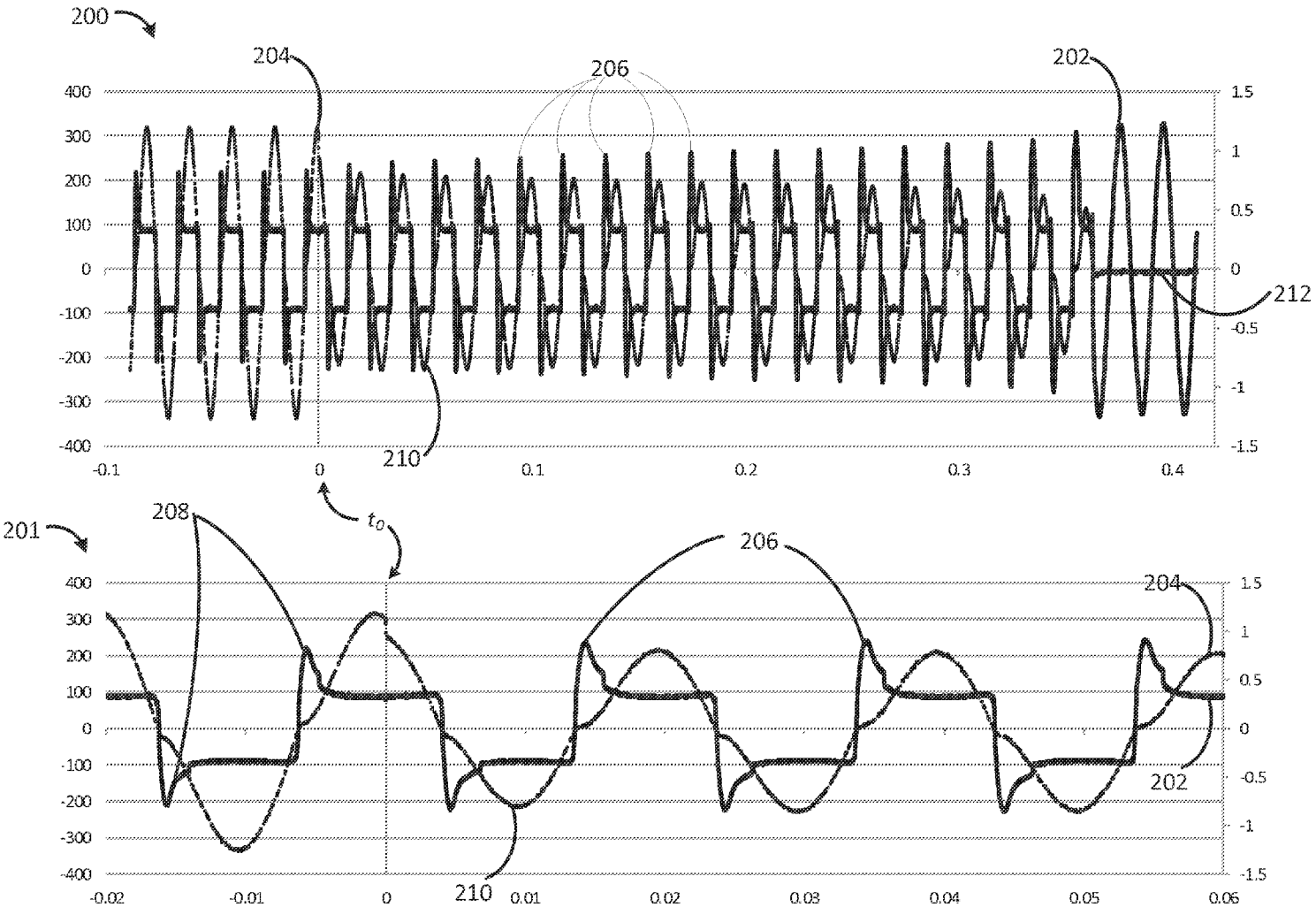
FIG. 2 illustrates exemplary graphs of HID lamp voltage and lamp current during transition from full power to dimmed power in a lighting apparatus incorporating aspects of the present disclosure.

FIG. 2 is a graph 200 illustrating lamp voltage 202 and lamp current 204 for a HID lamp 1100 being driven from a bi-power electromagnetic ballast such as the bi-power ballast 102 described above with reference to FIG. 1. Graph 200 plots lamp voltage 202 in volts on the left hand vertical scale and lamp current 204 in amperes on the right hand vertical scale against time in seconds on the horizontal axis. Graph 201 illustrates a portion of graph 200 with an expanded time scale more clearly illustrating the waveforms for the lamp voltage 202 and lamp current 204. These graphs 200, 201 illustrate waveforms for a lamp operating from 50 Hertz mains power where each mains cycle is 0.02 seconds long. Alternatively, the lamp can be operated from different frequency power sources such as the 60 Hertz mains power used in North America, or other suitable frequencies.

Graph 200 begins with a HID lamp 110 that is operating at full power in a stable and warmed up condition, where the waveform of the lamp voltage 202 is a square type waveform and contains spikes 208 after each zero crossing. These voltage spikes 208 have a magnitude of about 215 volts. The waveform of the lamp current 204 is sinusoidal in nature with a peak magnitude of about 1.2 amperes when the lamp power 118 is at full power. At time $t_0$ the lamp power 118 is switched or reduced to a dimmed power level with a peak current magnitude 210 of about 0.8 amps, which produces a dimmed brightness from the lamp 110. After the lamp power 118 is reduced at time $t_0$, the voltage spikes 206 undergo a transient voltage rise where the peak magnitude of the spikes 206 increase in magnitude for about 10 to 20 mains cycles.

As illustrated by graph 200 of FIG. 2, the lamp voltage in the first few mains cycles after the power reduction at time $t_0$ remains about the same as lamp voltage during full power operation (before time $t_0$). However during the following cycles the peak magnitude of the spikes 206 rises temporarily. When the peak lamp voltage reaches or gets close to the open circuit voltage of the ballast circuit used to drive the lamp 110, the lamp 110 may drop out or extinguish and the lamp current drops to zero at point 212. The rise of the peak voltage spikes 206 is temporary and depends on the frequency of the AC lamp power, which in electromagnetic ballasts is the same as the frequency of the mains power used to operate the ballast. The transient voltage rise may be expressed in terms of the number of cycles of the input power, or mains power, frequency and typically lasts about 18 mains cycles to reach the open circuit voltage and cause drop out.

Allowing a HID lamp to extinguish after transitioning to dimmed power results in an undesirable cool-down period before the lamp can be re-struck. This cool down time can adversely impact the usefulness of a HID lighting apparatus. It is therefore desirable to avoid extinguishing of the HID lamp after transitioning to dimmed power. As discussed above extinguishing of the lamp is caused by a temporary rise in lamp voltage occurring after lamp power is reduced. The rise in lamp voltage can be lessened by re-applying full power to the lamp for a short time during period where the transient voltage rise occurs.

Figure 3:
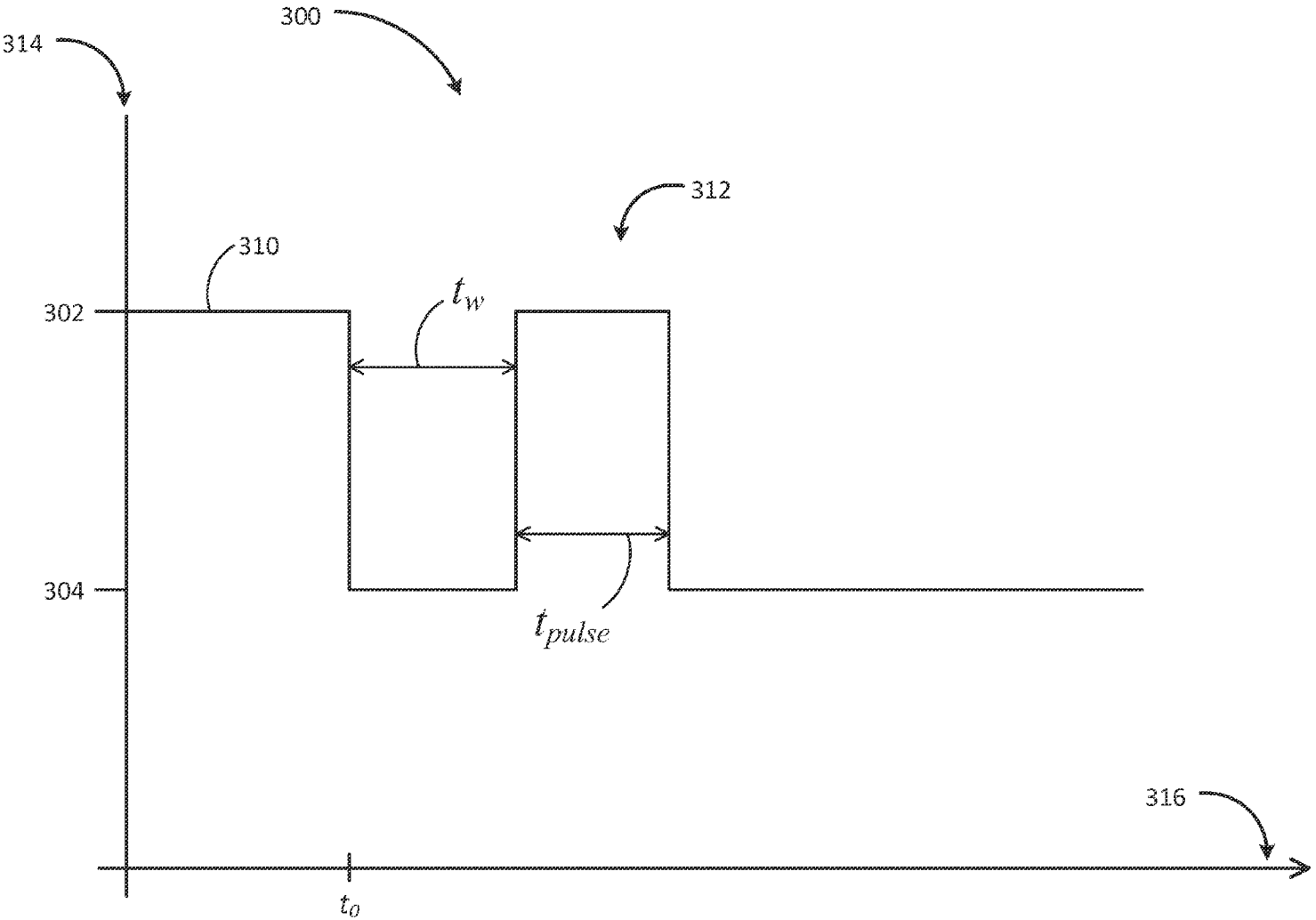
FIG. 3 illustrates a graph of HID lamp power during a transition from full power to dimmed power in a lighting apparatus incorporating aspects of the present disclosure.

FIG. 3 is an exemplary graph 300 illustrating lamp power 310 with the application of a full power pulse 312 before the transient voltage rise reaches the open circuit voltage to limit lamp voltage rise. Graph 300 shows a plot of lamp power 310 with magnitude on the vertical axis 314 and time on the horizontal axis 316. Graph 300 begins with the lamp power 310 set to a full power level 302. At time $t_0$ the lamp power 310 is reduced to a dimmed power level 304. After a short wait period, $t_w$, lamp power 310 is increased back to the full power level 302. The wait period $t_w$ should be greater than about 5 mains cycles and less than about 17 mains cycles and is preferably between about 6 mains cycles and 16 mains cycles. The lamp power 310 is left at the full power level 302 for a period of time, $t_{pulse}$, before being brought back to the dimmed power level 304.

The term "full power pulse" 310 as used herein describes a lamp power sequence that begins at a reduced lamp power level, increases to a full power level, and then decreases back to the dimmed power level. The amount of time the lamp power is left at the full power level during the full power pulse is the pulse width or pulse time $t_{pulse}$ and is similar in duration to the waiting time before the first pulse which is preferably less that about 16 mains cycles but greater than about 6 mains cycles in length. Applying a full power pulse 312 as shown in graph 300 can minimize the effects of transient voltage rise thereby preventing drop out of the lamp 110. In certain embodiments it is beneficial to apply more than one full power pulse 312 when transitioning from a full power level to a dimmed power level. When using a series of full power pulses 312, each pulse 312 can be separated from the previous pulse by the same amount of time or alternatively the wait time between full power pulses can be increased after each pulse.

Figure 4:
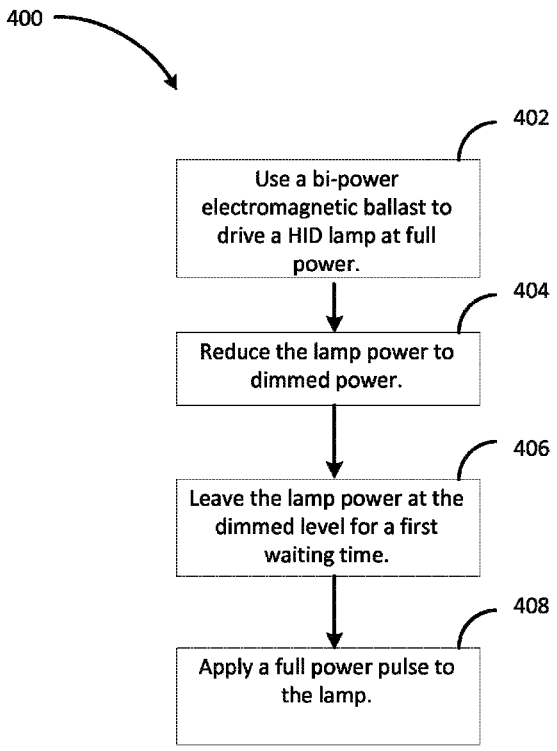
FIG. 4 illustrates a flow chart of a method of driving a HID lamp incorporating aspects of the present disclosure.

FIG. 4 is a flow chart illustrating an exemplary method 400 for preventing drop out after reducing HID lamp power with a bi-power electromagnetic ballast such as the ballast 102 described above. The exemplary method 400 begins with a step 402 by using a bi-power electromagnetic ballast 104 to drive a HID lamp 110 at a full power level such that the lamp 110 operates at a full brightness level. HID lamps are typically started at a full power level because starting a HID lamp at a reduced or dimmed power level can adversely affect lamp life. When dimmed brightness is desired the lamp power 118 is reduced to a dimmed power level in a step 404. The dimmed power level is lower than the full power level and may be less than 50% of the full power level depending on the type of HID lamp being used and the needs of the particular lighting application. The lamp power 118 is left at the dimmed power level for a waiting period in a step 406. The waiting period is dependent on the frequency of the mains power used to drive the electromagnetic ballast 102 and should be greater than about 5 mains cycles and less than about 17 mains cycles in length. After the waiting period a full power pulse 312 is applied to the lamp in a step 408. The full power pulse 312 is preferably applied within about 16 mains cycles but not less than about 6 mains cycles. In certain embodiments it is desirable to apply multiple full power pulses 312 where each full power pulse 312 is separated from the previous pulse by a waiting time. The length of the waiting period separating each full power pulse 312 may also be varied depending on the particular HID lamp and lighting application. For example successive waiting periods may be increase in length.

Thus, while there have been shown, described and pointed out, fundamental novel features of the invention as applied to the exemplary embodiments thereof, it will be understood that various omissions and substitutions and changes in the form and details of devices and methods illustrated, and in their operation, may be made by those skilled in the art without departing from the spirit and scope of the invention. Moreover, it is expressly intended that all combinations of those elements, which perform substantially the same function in substantially the same way to achieve the same results, are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for operating a HID lamp using a bi-power electromagnetic ballast, the method comprising:

applying a full power level to the HID lamp to produce full brightness;

applying a dimmed power level to the lamp to produce a dimmed brightness, wherein the dimmed power is less than the full power; and applying a full power pulse to the lamp to maintain the lamp in a dimmed state.

2. The method of claim 1, comprising applying the full power pulse within from 5 to 17 mains cycles after switching from the full power level to the dimmed power level.

3. The method of claim 1, wherein applying the full power pulse comprises applying one or more full power pulses to the lamp.

4. The method of claim 3, comprising applying the dimmed power to the lamp for at least 5 mains cycles and less than 17 mains cycles prior to applying each full power pulse.

5. The method of claim 1, wherein the full power pulse comprises a pulse time of at least 5 mains cycles but not more than 17 mains cycles.

6. The method of claim 1, wherein the HID lamp is a HPS lamp.

7. The method of claim 1, wherein the HID lamp is a CMH lamp.

8. A bi-power electromagnetic ballast for driving a HID lamp, the ballast comprising:

a ballasting power circuit configured to receive an AC input power and produce a lamp power;

a dimming circuit coupled to the ballasting power circuit and configured to control the ballasting power circuit to produce the lamp power at a full power level or a dimmed power level, wherein the dimmed power level is less than the full power level; and wherein the dimming circuit is configured to dim the lamp by:

switching the lamp power from the full power level to the dimmed power level;

waiting a first period of time;

switching the lamp power from the dimmed power level to the full power level;

waiting a pulse time; and switching the lamp power from the full power level to the dimmed power level.

9. The bi-power electromagnetic ballast of claim 8, wherein the dimming circuit is configured to switch the lamp power from the dimmed power level to the full power level and then back to the dimmed power level a plurality of times.

10. The bi-power electromagnetic ballast of claim 8, wherein the first period of time is greater than 5 mains cycles and less than 17 mains cycles.

11. The bi-power electromagnetic ballast of claim 8, wherein the pulse time is greater than 5 mains cycles and less than 17 mains cycles.

12. An electric lighting apparatus comprising:

a bi-power electromagnetic ballast configured to receive an AC input power and produce a lamp power; and a HID lamp coupled to the electromagnetic ballast and configured to receive the lamp power, wherein the bi-power electromagnetic ballast is configured to:

produce the lamp power at a full power level and a dimmed power level, wherein the full power level is greater than the dimmed power level, and wherein the electromagnetic ballast is configured to dim the HID lamp by:

reducing the lamp power from the full power level to the dimmed power level; and applying a full power pulse to the HID lamp.

13. The electric lighting apparatus of claim 12, wherein the electromagnetic ballast is configured to dim the lamp by reducing the lamp power from the full power level to the dimmed power level, and then applying a plurality of full power pulses to the HID lamp.

14. The electric lighting apparatus of claim 13, wherein a time between reducing the lamp power to the dimmed power level and applying the full power pulses is at least 5 mains cycles and less than 17 mains cycles.

15. The electric lighting apparatus of claim 12, wherein applying the full power pulse to the HID lamp comprises switching the lamp power from the dimmed power level to the full power level, waiting a pulse time, and then switching the lamp power back to the dimmed power level.

16. The electric lighting apparatus of claim 15, wherein the pulse time is greater than 5 mains cycles and less than 17 mains cycles.

17. The electric lighting apparatus of claim 13, wherein the lamp power remains at the dimmed power level for at least 5 mains cycles and less than 17 mains cycles between each full power pulse.

18. The electric lighting apparatus of claim 17, wherein each full power pulse has a pulse width of at least 5 mains cycles and less than 17 mains cycles.

19. The electric lighting apparatus of claim 12, wherein the HID lamp is a HPS lamp.

20. The electric lighting apparatus of claim 12, wherein the HID lamp is a CMH lamp.

* * * * *